US007360666B1

(12) United States Patent
Primel et al.

(10) Patent No.: US 7,360,666 B1
(45) Date of Patent: Apr. 22, 2008

(54) PORTABLE FOOD, BEVERAGE AND UTENSIL HOLDER

(76) Inventors: Rene Primel, P.O. Box 335, 124 N. Mill St., Mann's Choice, PA (US) 15550; Shirley Sprigg, P.O. Box 294, Manns Choice, PA (US) 15550; William J Wolfe, P.O. Box 612, Bedford, PA (US) 15522

( * ) Notice: Subject to any disclaimer, the term of this patent is extended or adjusted under 35 U.S.C. 154(b) by 227 days.

(21) Appl. No.: 11/236,464

(22) Filed: Sep. 28, 2005

(51) Int. Cl.
*B65D 25/28* (2006.01)
*B65D 21/02* (2006.01)

(52) U.S. Cl. ..... 220/759; 220/752; 220/23.8

(58) Field of Classification Search ..... 220/23.8, 220/23.6, 23.4, 23.83, 759, 752, 575, 507, 220/503, 574; 206/501, 217, 564, 561; D7/555
See application file for complete search history.

(56) References Cited

U.S. PATENT DOCUMENTS

| | | | | | |
|---|---|---|---|---|---|
| 28,693 | A | * | 6/1860 | Shirley | 220/23.8 |
| 231,034 | A | * | 8/1880 | Goessling | 220/575 |
| D22,305 | S | * | 3/1893 | Gulick | D7/555 |
| 2,107,381 | A | * | 2/1938 | Leppke | 220/23.83 |
| 2,240,020 | A | | 4/1941 | Raiser | |
| 2,561,022 | A | | 7/1951 | Jones | |
| 4,534,474 | A | * | 8/1985 | Ng | 211/70 |
| 4,718,555 | A | * | 1/1988 | Amberg | 206/519 |
| 4,732,274 | A | | 3/1988 | Bouton | |
| D297,799 | S | | 9/1988 | Hammer | |
| 4,823,958 | A | | 4/1989 | Mahmud | |
| D303,194 | S | | 9/1989 | Darby et al. | |
| 5,176,283 | A | * | 1/1993 | Patterson et al. | 220/574 |
| 6,135,307 | A | * | 10/2000 | Fahy | 220/574 |
| D507,933 | S | * | 8/2005 | Carmichael | D7/505 |
| 6,971,612 | B1 | * | 12/2005 | Wilson-Lowery | 248/104 |
| 2006/0226154 | A1 | * | 10/2006 | Lundy et al. | 220/507 |
| 2006/0266748 | A1 | * | 11/2006 | Crawford | 220/23.8 |
| 2007/0029213 | A1 | * | 2/2007 | Hall | 206/217 |

* cited by examiner

*Primary Examiner*—Anthony D. Stashick
*Assistant Examiner*—Robert J Hicks

(57) ABSTRACT

An apparatus includes a body that has a planar bottom surface, sidewalls extending upwardly therefrom, and linear dividers radially protruding away from a center of the body. The dividers cooperate with the sidewalls for defining compartments for housing food stuff therein. The body has a lip vertically offset from the bottom surface. The dividers have proximal ends juxtaposed adjacent to the lip and adjoining an outer perimeter thereof. The perimeter of the lip has a threaded outer surface. A receptacle confronts a selected side wall and has a planar bottom surface and side walls protruding upwardly therefrom. The receptacle houses utensils therein such that the user can simultaneously support utensils, food stuff and a beverage on the body. A cup holder rests on the lip and is removably engageable therewith. A handle that has a frusto-conical shape is removably engageable with the lip.

15 Claims, 5 Drawing Sheets

PORTABLE FOOD, BEVERAGE AND UTENSIL HOLDER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to food, beverage and utensil holders and, more particularly, to a portable food, beverage and utensil holder for assisting a user to support food stuff, a beverage and utensil supplies on a single platform.

2. Prior Art

With the interest in paper plates and other disposable food carriers, it is not surprising that a number of prior art apparatuses over the years have been directed to trays and other types of food carriers. It is desirable particularly for use at ballgames, picnics, parties and like events to have a disposable tray table which can support both food and a beverage contained in a cup.

It would be particularly desirable if such a tray table could be designed which includes a surface for supporting food and means for supporting a cup which can be supported on a person's lap, tabletop or other such surface and which can, be readily carried by one hand of a user to permit the other hand to be used for consuming the food and beverage supported on the tray table. Unfortunately, none of the currently available prior art examples offer such a combination of features.

Accordingly, a need remains for a portable food, beverage and utensil holder in order to overcome the above-noted shortcomings. The present invention satisfies such a need by providing a holder that is convenient and easy to use, attractive and practical in design, reasonably priced, and effective in use. A user can enjoy any number of snacks and food while their beverage is safely stabilized. The portable food, beverage and utensil holder provides a user with an easier method of eating outdoors, while being able to accommodate any style and size of cup.

BRIEF SUMMARY OF THE INVENTION

In view of the foregoing background, it is therefore an object of the present invention to provide a portable food, beverage and utensil holder. These and other objects, features, and advantages of the invention are provided by an apparatus for assisting a user to support food stuff, beverage and utensil supplies on a single platform.

The apparatus includes a body formed from non-porous material and has a substantially planar bottom surface and further has monolithically formed sidewalls vertically extending upwardly therefrom. The side walls may have linear shapes for advantageously minimizing undesirable rolling movement of foodstuff contained with the compartments. Such a body includes a plurality of linear dividers radially protruding away from a center of the body that have distal end portions monolithically formed with the sidewalls respectively. The dividers cooperate with the sidewalls for defining a plurality of compartments for conveniently housing food stuff therein such that the food stuff can advantageously be effectively maintained in a predetermined area defined by selected ones of the compartments.

The body further has an annular lip vertically offset from the bottom surface and is centrally disposed on the bottom surface. The dividers further have proximal end portions juxtaposed adjacent to the lip and adjoining an outer perimeter thereof wherein the perimeter of the lip has a threaded outer surface. Such a lip preferably further includes a raised bottom surface vertically offset from the bottom surface of the body. Such a raised bottom surface has a threaded inner wall.

The body also includes a monolithically formed receptacle confronting a selected one of the side walls. Such a receptacle has a longitudinal length coextensively sized with the selected side wall. The receptacle has a substantially planar bottom surface and monolithically formed side walls vertically protruding upwardly therefrom for defining an elongated chamber isolated from the compartments. Such a receptacle is suitably sized and shaped for effectively and conveniently housing utensils therein such that the user can simultaneously support utensils, food stuff and a beverage on the body.

A cup holder is suitably sized and shaped for resting directly on the lip and is removably engageable with the lip. Such a cup holder may include a stepped inner surface converging downwardly toward the bottom surface thereof. The stepped inner surface effectively defines a plurality of sections that have unique diameters for advantageously and conveniently receiving a variety of beverage cups therein respectively. The cup holder further has an offset bottom surface protruding downwardly therefrom and provided with a threaded inner surface. Such a threaded inner surface is threadably mated with the outer surface of the lip for advantageously and effectively supporting a beverage at a substantially vertical position.

The bottom surface of the cup holder may be isolated from the handle so that undesirable condensation from a beverage cup is prohibited from traveling beyond the bottom surface of the body. Such a cup holder is provided with a centrally registered longitudinal axis passing through a center of the lip and the cup holder respectively so that a user can advantageously and effectively balance the apparatus by merely engaging the handle with one hand during operating conditions. The cup holder preferably has a longitudinal length shorter than a longitudinal length of the handle.

A handle that has a frusto-conical shape is removably engageable directly with the lip. Such a handle preferably has a top end portion provided with a threaded outer surface. The threaded outer surface of the handle is removably and directly engageable with the inner wall of the lip bottom surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
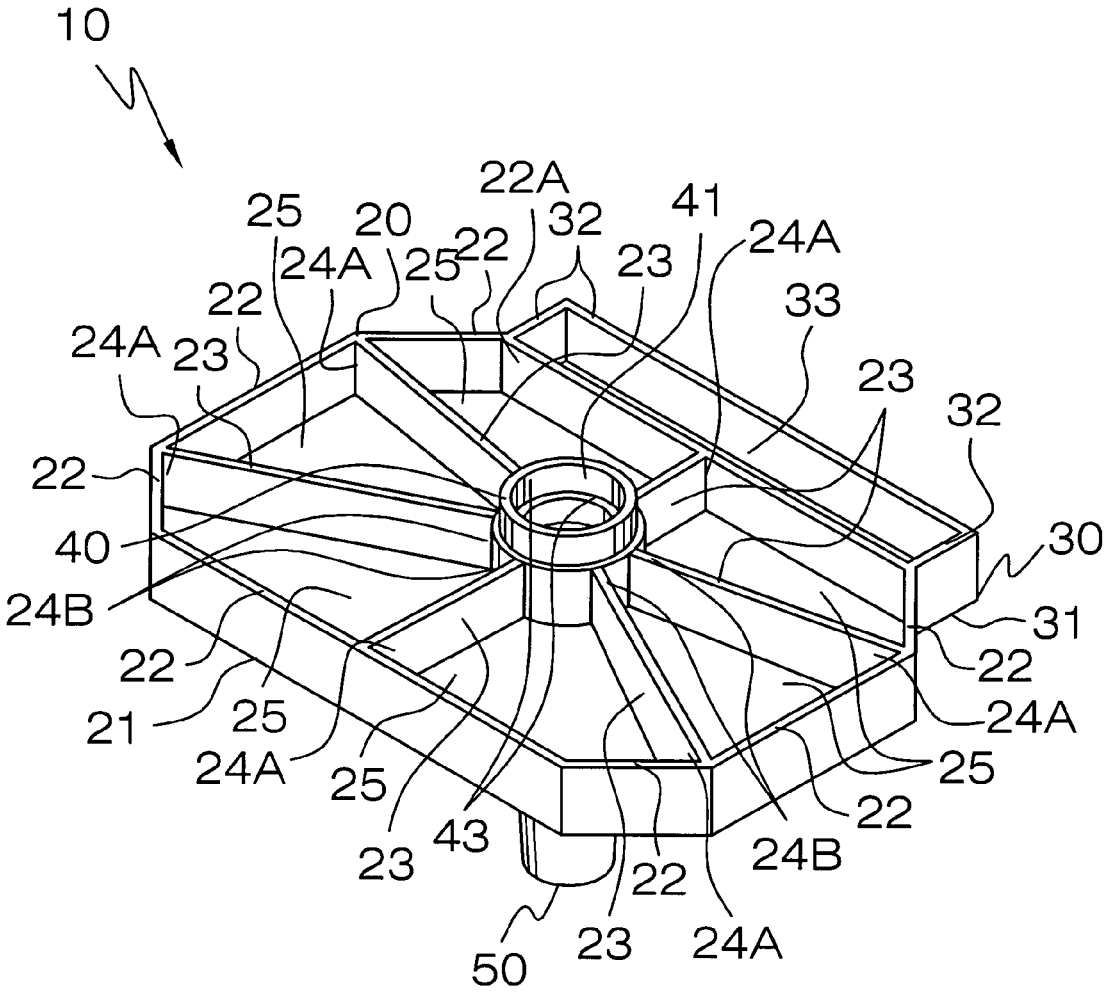
FIG. 1 is a perspective view showing a portable food, beverage and utensil holder, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a portable food, beverage and utensil holder. It should be understood that the apparatus 10 may be used to hold many different types of items and should not be limited in use to only holding food, beverages and utensils.

Referring initially to FIG. 1, the apparatus 10 includes a body 20 formed from non-porous material that has a substantially planar bottom 21 surface and further has monolithically formed sidewalls 22 vertically extending upwardly therefrom. Such side walls 22 have linear shapes, is critical for advantageously minimizing undesirable rolling movement of foodstuff contained with the compartments 25 (described herein below). This feature advantageously prevents a person from spilling foodstuff on themselves and their clothing, thus saving the user a considerable amount of frustration and time that would be spent cleaning their clothes.

Figure 2:
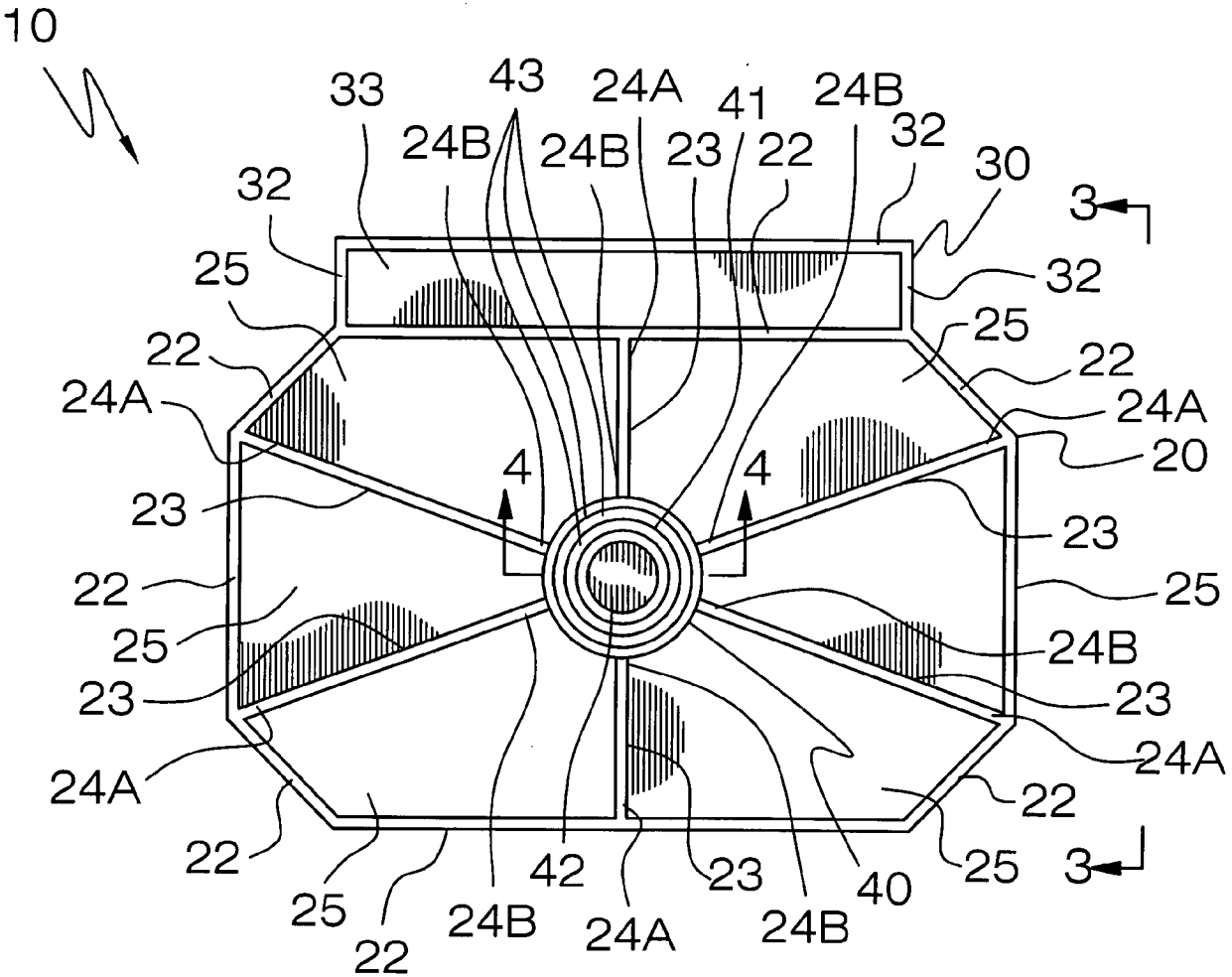
FIG. 2 is a top plan view of the apparatus shown in FIG. 1.
Figure 3:
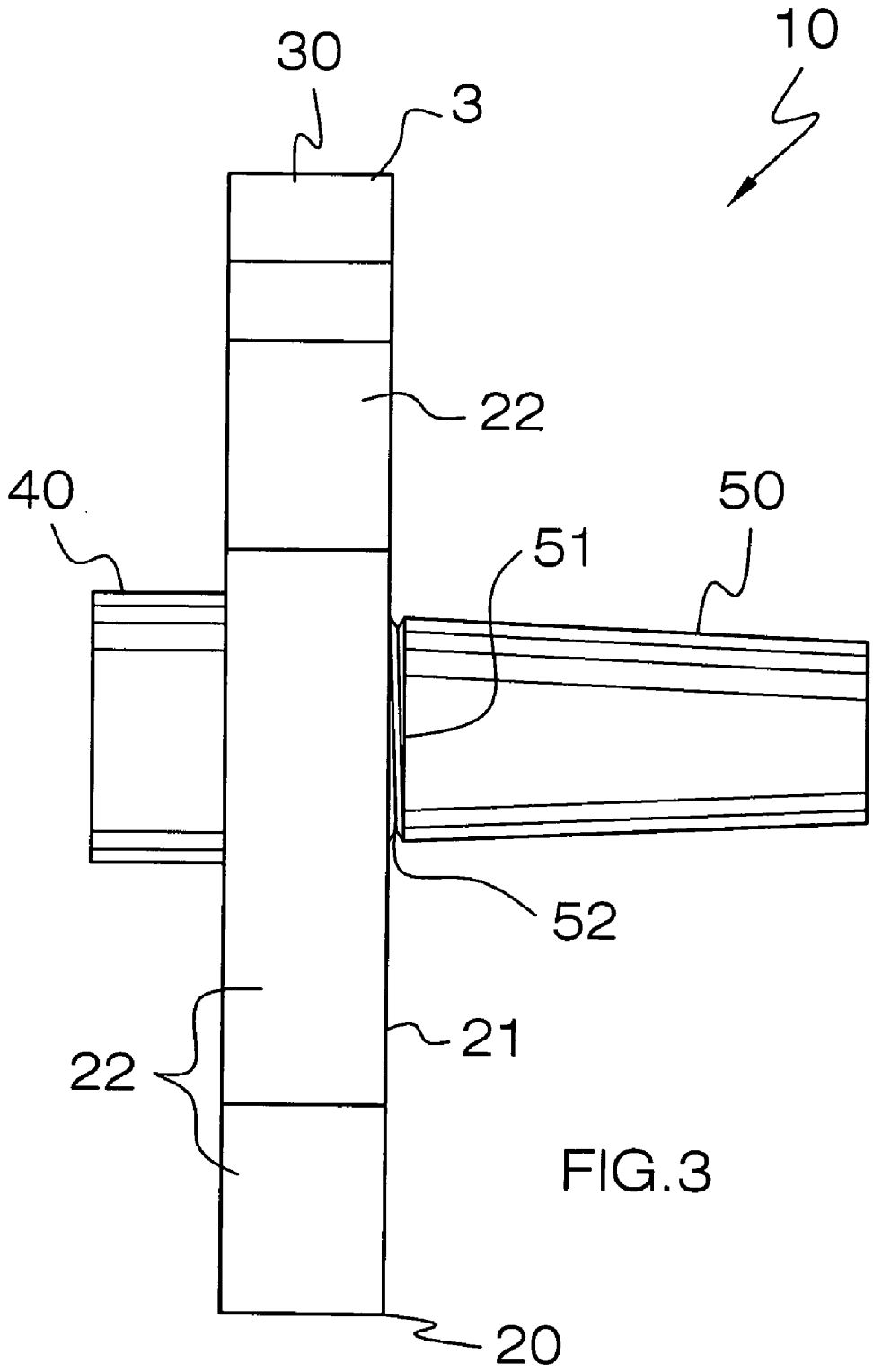
FIG. 3 is a side-elevational view of the apparatus shown in FIG. 2, taken along line 2-2.
Figure 5:
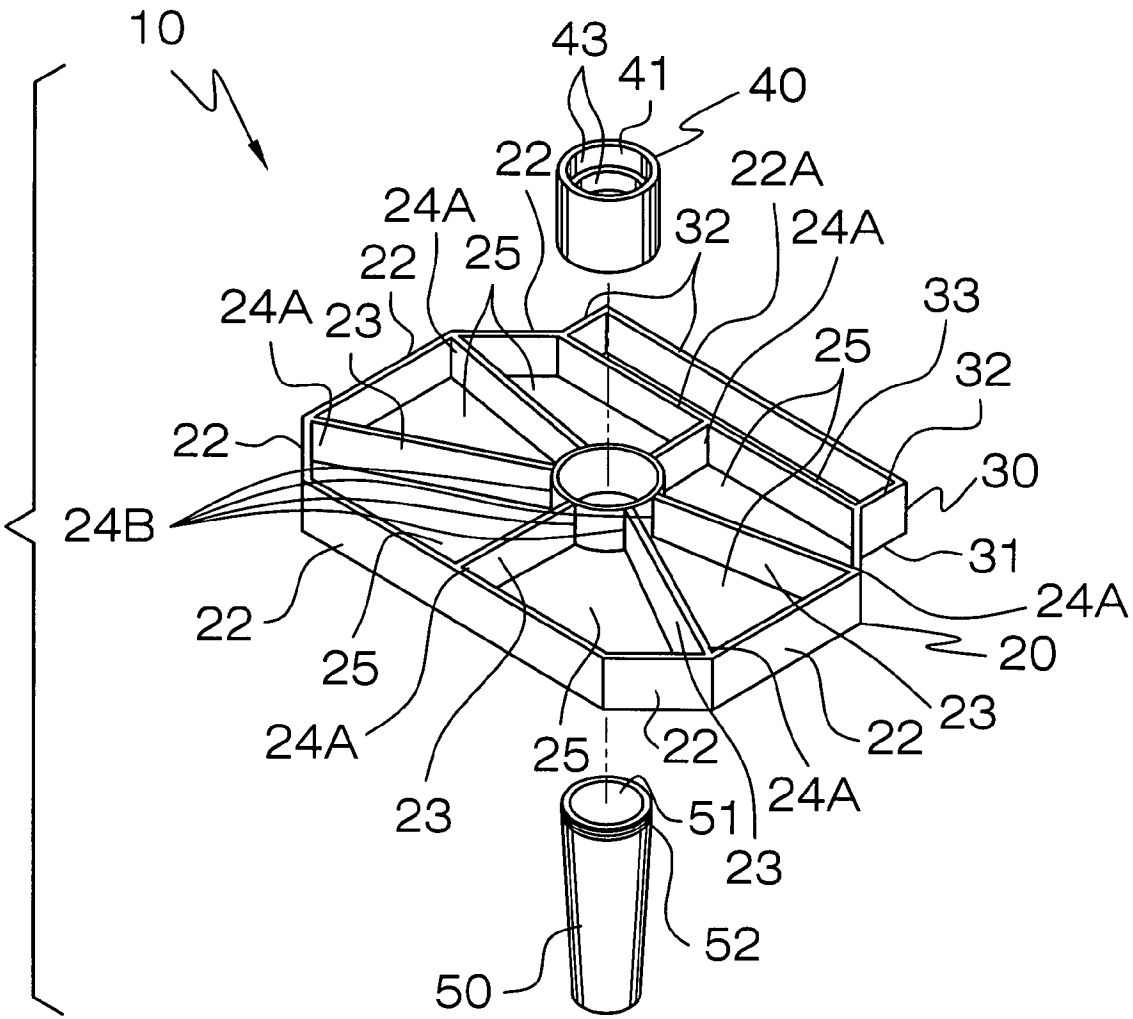
FIG. 5 is an exploded perspective view of the apparatus shown in FIG. 1.

Referring to FIGS. 1, 2 and 5, the body 20 includes a plurality of linear dividers 23 radially protruding away from a center of the body 20 that have distal end portions 24A monolithically formed with the sidewalls 22 respectively. Of course, the dividers 23 may be oriented in variety of different ways so as to form alternately shaped and sized compartments 25, as is obvious to a person of ordinary skill in the art. Such dividers 23 cooperate with the sidewalls 22 for defining a plurality of compartments 25 that are important for conveniently housing food stuff therein such that the food stuff can advantageously be effectively maintained in a predetermined area defined by selected ones of the compartments 25. Of course, the compartments 25 my house items other than foodstuff therein, as is obvious to a person of ordinary skill in the art.

Figure 4:
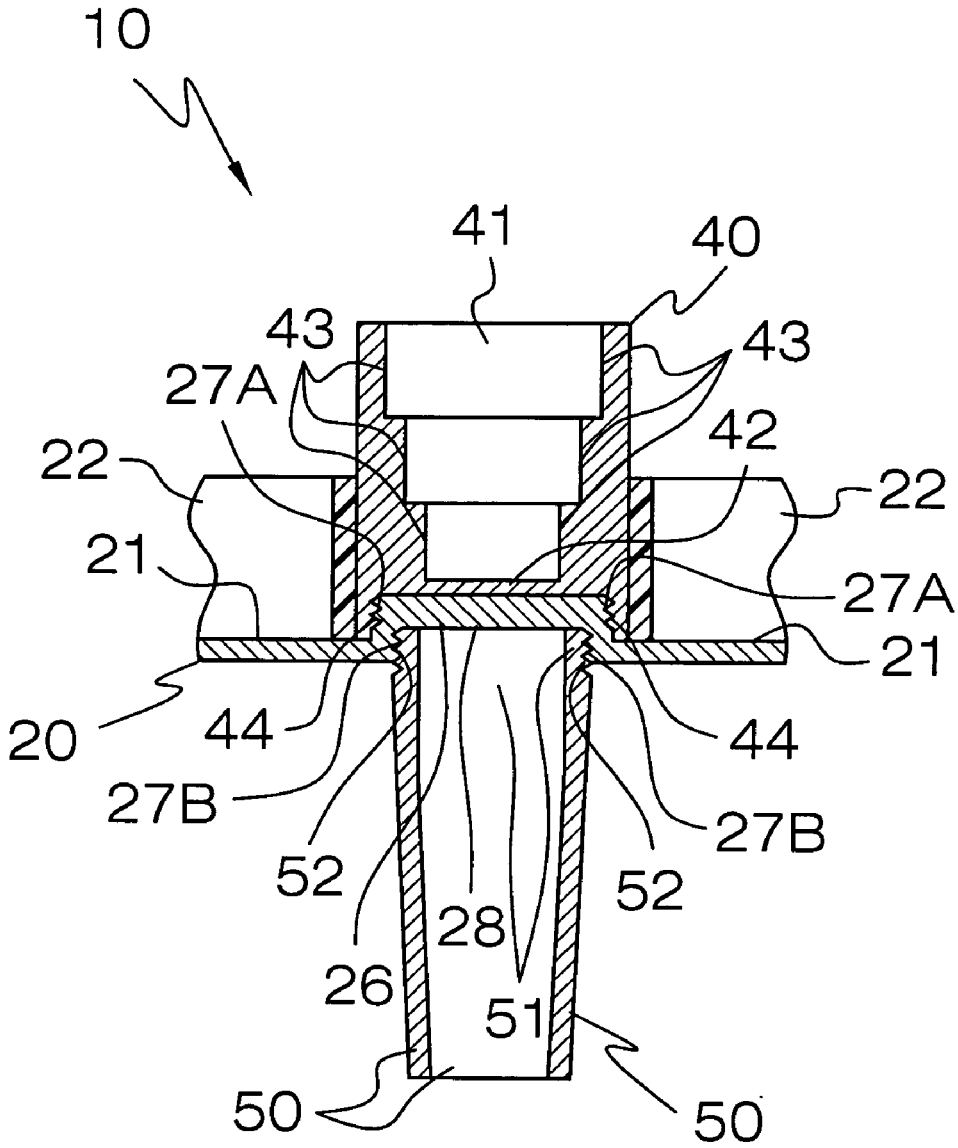
FIG. 4 is a cross-sectional view of cup holder and handle shown in FIG. 2, taken along line 4-4.

Referring to FIGS. 4 and 5, the body 20 further has an annular lip 26 vertically offset from the bottom surface 21 and is centrally disposed on the bottom surface 21. Of course, the lip 26 may be positioned at any suitable location along the bottom surface 21 of the body 20, as is obvious to a person of ordinary skill in the art. The dividers 23 further have proximal end portions 24B juxtaposed adjacent to the lip 26 and adjoining an outer perimeter thereof. The perimeter of the lip 26 has a threaded outer surface 27A. Such a lip 26 further includes a raised bottom surface 28 vertically offset from the bottom surface 21 of the body 20. The raised bottom surface 28 has a threaded inner wall 27B.

Referring to FIGS. 1, 2, 3 and 5, the body 20 also includes a monolithically formed receptacle 30 confronting a selected one 22A of the side walls 22. Such a receptacle 30 has a longitudinal length coextensively sized with the selected side wall 22A. Of course, the receptacle 30 may be produced in a variety of different lengths and shapes, and may be positioned along any of the side walls 22, as is obvious to a person of ordinary skill in the art.

The receptacle 30 has a substantially planar bottom surface 31 and monolithically formed side walls 32 vertically protruding upwardly therefrom for defining an elongated chamber 33 isolated from the compartments 25. Such a receptacle 30 is suitably sized and shaped for effectively and conveniently housing utensils (not shown) therein, which is critical and advantageous such that the user can simultaneously support utensils, food stuff and a beverage on the body 20. Of course, the receptacle 30 may be used to house a number of different items and should not be limited to holding only utensils, as is obvious to a person of ordinary skill in the art.

Referring to FIGS. 1 through 5, a cup holder 40 is suitably sized and shaped for resting directly, with no intervening elements, on the lip 26 and is removably engageable with the lip 26. Such a cup holder 40 includes a stepped inner surface 41 converging downwardly toward the bottom surface 42 (described herein below) thereof. The stepped inner surface 41 effectively defines a plurality of sections 43 that have unique diameters that are vital for advantageously and conveniently receiving a variety of beverage cups therein respectively. The cup holder 40 further has an offset bottom surface 42 protruding downwardly therefrom and provided with a threaded inner surface 44. Such a threaded inner surface 44 is threadably mated with the outer surface 27A of the lip 26, which is essential for advantageously and effectively supporting a beverage at a substantially vertical position.

Referring to FIG. 4, the bottom surface 42 of the cup holder 40 is isolated from the handle 50 (described herein below), which is vital and advantageous so that undesirable condensation from a beverage cup is prohibited from traveling beyond the bottom surface 21 of the body 20. Such a cup holder 40 is provided with a centrally registered longitudinal axis passing through a center of the lip 26 and the cup holder 40 respectively so that a user can advantageously and effectively balance the apparatus 10 by merely engaging the handle 50 with one hand during operating conditions. This feature conveniently allows the individual to maintain use of their other hand for eating and drinking the foodstuff and beverage, respectively. The cup holder 40 has a longitudinal length shorter than a longitudinal length of the handle 50, as is best shown in FIG. 4.

Referring to FIGS. 1, 3, 4 and 5, a handle 50 that has a frusto-conical shape is removably engageable directly, with no intervening elements, with the lip 26. Of course, the handle 50 may be produced in a variety of different shapes and sizes, as is obvious to a person of ordinary skill in the art. Such a handle 50 has a top end portion 51 provided with a threaded outer surface 52. The threaded outer surface 52 of the handle is removably and directly engageable, with no intervening elements, with the inner wall 27B of the lip bottom surface 28. This feature advantageously and effectively ensures that the handle 50 remains attached to the body 20 during operating conditions, while also allowing for convenient and easy removal of the handle 50 as the user's needs require.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. An apparatus for assisting a user to support food stuff, beverage and utensil supplies on a single platform, said apparatus comprising:

a body formed from non-porous material and having a substantially planar bottom surface and further having monolithically formed sidewalls vertically extending upwardly therefrom, said body including a plurality of linear dividers radially protruding away from a center of said body and having distal end portions monolithically formed with said sidewalls respectively, said dividers cooperating with said sidewalls for defining a plurality of compartments for housing food stuff therein such that the food stuff can be effectively maintained in a predetermined area defined by selected ones of said compartments, said body further having an annular lip vertically offset from said bottom surface and centrally disposed on said bottom surface, said dividers further having proximal end portions juxtaposed adjacent said lip and adjoining an outer perimeter thereof wherein the perimeter of said lip has a threaded outer surface;

a cup holder suitably sized and shaped for resting directly on said lip and being removably engageable with said lip; and a handle having a frusto-conical shape removably engageable directly with said lip;

wherein said lip further includes a raised bottom surface vertically offset from said bottom surface of said body and seated thereabove, said raised bottom surface having a threaded inner wall;

said handle having a top end portion provided with a threaded outer surface, said threaded outer surface of said handle being removably and directly engaged with said inner wall of said lip bottom surface and nested directly below said lip;

wherein said bottom surface of said lip is planar and registered parallel to said bottom surface of said body;

wherein said cup holder has a bottom most end directly engaged with said bottom surface of said body and concentrically positioned about said threaded outer surface;

wherein said top end portion of said handle terminates above said bottom surface of said body and below said bottom surface of said lip respectively.

2. The apparatus of claim 1, wherein said cup holder comprises; a stepped inner surface converging downwardly toward said bottom surface thereof, said stepped inner surface defining a plurality of sections having unique diameters for receiving a variety of beverage cups therein respectively;

said cup holder further having an offset bottom surface protruding downwardly therefrom and provided with a threaded inner surface, said threaded inner surface being threadably mated with said outer surface of said lip for supporting a beverage at a substantially vertical position.

3. The apparatus of claim 2, wherein said bottom surface of said cup holder is isolated from said handle so that undesirable condensation from a beverage cup is prohibited from traveling beyond said bottom surface of said body, said cup holder being provided with a centrally registered longitudinal axis passing through a center of said lip and said cup holder respectively so that a user can effectively balance said apparatus by merely engaging said handle with one hand during operating conditions.

4. The apparatus of claim 1, wherein said side walls have linear shapes for minimizing undesirable rolling movement of foodstuff contained with said compartments.

5. The apparatus of claim 1, wherein said cup holder has a longitudinal length shorter than a longitudinal length of said handle.

6. An apparatus for assisting a user to support food stuff, beverage and utensil supplies on a single platform, said apparatus comprising:

a body formed from non-porous material and having a substantially planar bottom surface and further having monolithically formed sidewalls vertically extending upwardly therefrom, said body including a plurality of linear dividers radially protruding away from a center of said body and having distal end portions monolithically formed with said sidewalls respectively, said dividers cooperating with said sidewalls for defining a plurality of compartments for housing food stuff therein such that the food stuff can be effectively maintained in a predetermined area defined by selected ones of said compartments, said body further having an annular lip vertically offset from said bottom surface and centrally disposed on said bottom surface, said dividers further having proximal end portions juxtaposed adjacent said lip and adjoining an outer perimeter thereof wherein the perimeter of said lip has a threaded outer surface, said body further including a monolithically formed receptacle confronting a selected one of said side walls, said receptacle having a longitudinal length coextensively sized with said selected side wall, said receptacle having a substantially planar bottom surface and monolithically formed side walls vertically protruding upwardly therefrom for defining an elongated chamber isolated from said compartments;

a cup holder suitably sized and shaped for resting directly on said lip and being removably engageable with said lip; and a handle having a frusto-conical shape removably engageable directly with said lip;

wherein said lip further includes a raised bottom surface vertically offset from said bottom surface of said body and seated thereabove, said raised bottom surface having a threaded inner wall;

said handle having a top end portion provided with a threaded outer surface, said threaded outer surface of said handle being removably and directly engaged with said inner wall of said lip bottom surface and nested directly below said lip;

wherein said bottom surface of said lip is planar and registered parallel to said bottom surface of said body;

wherein said cup holder has a bottom most end directly engaged with said bottom surface of said body and concentrically positioned about said threaded outer surface;

wherein said top end portion of said handle terminates above said bottom surface of said body and below said bottom surface of said lip respectively.

7. The apparatus of claim 6, wherein said cup holder comprises: a stepped inner surface converging downwardly toward said bottom surface thereof, said stepped inner surface defining a plurality of sections having unique diameters for receiving a variety of beverage cups therein respectively;

said cup holder further having an offset bottom surface protruding downwardly therefrom and provided with a threaded inner surface, said threaded inner surface being threadably mated with said outer surface of said lip for supporting a beverage at a substantially vertical position.

8. The apparatus of claim 7, wherein said bottom surface of said cup holder is isolated from said handle so that undesirable condensation from a beverage cup is prohibited from traveling beyond said bottom surface of said body, said cup holder being provided with a centrally registered longitudinal axis passing through a center of said lip and said cup holder respectively so that a user can effectively balance said apparatus by merely engaging said handle with one hand during operating conditions.

9. The apparatus of claim 6, wherein said side walls have linear shapes for minimizing undesirable rolling movement of foodstuff contained with said compartments.

10. The apparatus of claim 6, wherein said cup holder has a longitudinal length shorter than a longitudinal length of said handle.

11. An apparatus for assisting a user to support food stuff, beverage and utensil supplies on a single platform, said apparatus comprising:

a body formed from non-porous material and having a substantially planar bottom surface and further having monolithically formed sidewalls vertically extending upwardly therefrom, said body including a plurality of linear dividers radially protruding away from a center of said body and having distal end portions monolithically formed with said sidewalls respectively, said dividers cooperating with said sidewalls for defining a plurality of compartments for housing food stuff therein such that the food stuff can be effectively maintained in a predetermined area defined by selected ones of said compartments, said body further having an annular lip vertically offset from said bottom surface and centrally disposed on said bottom surface, said dividers further having proximal end portions juxtaposed adjacent said lip and adjoining an outer perimeter thereof wherein the perimeter of said lip has a threaded outer surface, said body further including a monolithically formed receptacle confronting a selected one of said side walls, said receptacle having a longitudinal length coextensively sized with said selected side wall, said receptacle having a substantially planar bottom surface and monolithically formed side walls vertically protruding upwardly therefrom for defining an elongated chamber isolated from said compartments, said receptacle being suitably sized and shaped for housing utensils therein such that the user can simultaneously support utensils, food stuff and a beverage on said body;

a cup holder suitably sized and shaped for resting directly on said lip and being removably engageable with said lip; and a handle having a frusto-conical shape removably engageable directly with said lip;

wherein said lip further includes a raised bottom surface vertically offset from said bottom surface of said body and seated thereabove, said raised bottom surface having a threaded inner wall;

said handle having a top end portion provided with a threaded outer surface, said threaded outer surface of said handle being removably and directly engaged with said inner wall of said lip bottom surface and nested directly below said lip;

wherein said bottom surface of said lip is planar and registered parallel to said bottom surface of said body;

wherein said cup holder has a bottom most end directly engaged with said bottom surface of said body and concentrically positioned about said threaded outer surface;

wherein said top end portion of said handle terminates above said bottom surface of said body and below said bottom surface of said lip respectively.

12. The apparatus of claim 11, wherein said cup holder comprises: a stepped inner surface converging downwardly toward said bottom surface thereof, said stepped inner surface defining a plurality of sections having unique diameters for receiving a variety of beverage cups therein respectively;

said cup holder further having an offset bottom surface protruding downwardly therefrom and provided with a threaded inner surface, said threaded inner surface being threadably mated with said outer surface of said lip for supporting a beverage at a substantially vertical position.

13. The apparatus of claim 12, wherein said bottom surface of said cup holder is isolated from said handle so that undesirable condensation from a beverage cup is prohibited from traveling beyond said bottom surface of said body, said cup holder being provided with a centrally registered longitudinal axis passing through a center of said lip and said cup holder respectively so that a user can effectively balance said apparatus by merely engaging said handle with one hand during operating conditions.

14. The apparatus of claim 11, wherein said side walls have linear shapes for minimizing undesirable rolling movement of foodstuff contained with said compartments.

15. The apparatus of claim 11, wherein said cup holder has a longitudinal length shorter than a longitudinal length of said handle.

* * * * *